United States Patent [19]

Nishida

[11] 4,385,218

[45] May 24, 1983

[54] ELECTRIC SWITCH

[75] Inventor: Masayoshi Nishida, Neyagawa, Japan

[73] Assignee: Matsushita Electric Industrial Co., Ltd., Kadoma, Japan

[21] Appl. No.: 256,164

[22] Filed: Apr. 21, 1981

[51] Int. Cl.[3] ..... H01H 5/26; H01H 5/30; H01H 13/44; H01H 13/64

[52] U.S. Cl. ..... 200/159 B; 200/67 DA; 200/159 A

[58] Field of Search ..... 200/159 A, 159 B, 67 DA, 200/5 A

[56] References Cited

U.S. PATENT DOCUMENTS

| | | | |
|---|---|---|---|
| 3,673,357 | 6/1972 | Molchan | 200/159 B |
| 3,973,091 | 8/1976 | Kaminski | 200/5 A |
| 3,996,429 | 12/1976 | Chu et al. | 200/5 A |
| 4,005,293 | 1/1977 | Boulanger | 200/159 B |
| 4,331,851 | 5/1982 | Johnson | 200/159 B |

FOREIGN PATENT DOCUMENTS

| | | | |
|---|---|---|---|
| 2609134 | 9/1977 | Fed. Rep. of Germany | 200/159 B |

*Primary Examiner*—John W. Shepperd

*Attorney, Agent, or Firm*—Cushman, Darby & Cushman

[57] ABSTRACT

A moving contact of diaphragm-like resilient metal capable of a vertical self-restoring deformation is disclosed. The moving contact has a frame structure of upwardly-inflected generally partially cylindrical configuration in constant contact with one of several fixed contacts, and a central structure of generally partial hemispherical configuration, convexed in the same direction as the inflection of said frame structure, integrally formed with said frame structure but separated therefrom by at least one elongated and curved slot partially surrounding said central structure, so as to be deformable at least partly independent from the deformation of said frame structure. Said moving contact, when it receives a pushing-down action on its central structure, first deforms resiliently at its frame structure and then at its central structure sequentially, so that it is designed to be brought into contact with corresponding fixed contacts in consecutive order. Thus the present invention can provide a smaller, lighter and less expensive, push-on type switch capable of performing a two-stage switching operation in a single pushing-down manipulation of its actuation member with a notched touch in the same direction.

11 Claims, 12 Drawing Figures

ELECTRIC SWITCH

BACKGROUND OF THE INVENTION

1. Field of the Invention

The present invention relates to an electric switch of push-on type. Particularly, it is concerned with a push-on switch capable of performing a two-stage switching operation in a single pushing-down manipulation of its actuation member with a notch-like touch in the same direction.

2. Description of the Prior Art

Hithertofore, a push-on switch of the known type capable of performing a two-stage switching operation in a pushing-down manipulation of the actuation member in the same direction has been complex and expensive because a complex mechanism must be provided for accurately sensing the downward stroke of the actuation member and for holding the member at an intermediate position with an acceptable stability.

SUMMARY OF THE INVENTION

It is therefore the primary object of the present invention to provide a push-on type switch capable of performing a two-stage switching operation in a single pushing-down manipulation of its actuation member with a notch-like touch in the same direction.

It is another object of the present invention to provide a switch having the abovementioned feature of smaller size, lighter weight and lower cost.

DESCRIPTION OF PREFERRED EMBODIMENT

Figure 1:
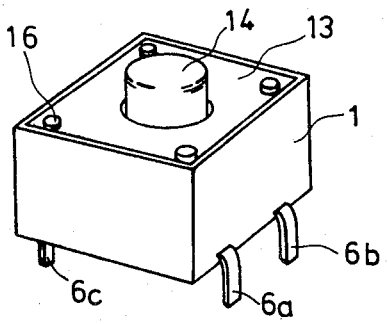
FIG. 1 is a perspective view of a switch embodying the present invention.

According to the present invention there is provided a switch including an insulator case having a recessed space for accommodating therein, at least three fixed contacts fixedly disposed on the bottom face thereof, a moving diaphragm-like contact of resilient metal capable of a vertical self-restoring deformation within said space, an actuation member capable of receiving a pushing-down manipulation and transmitting the corresponding downward movement to said moving contact to induce a sequential and resilient deformation of the moving contact, and a lid adapted to said recessed space and capable of holding said moving contact and said actuation member while permitting the deformation of the former and the vertical movement of the latter within said recessed space.

The moving contact comprises:

(a) a frame structure of segmental generally cylindrical configuration and of upwardly inflected shape, having a peripheral contour fitted to the inner side wall of said recessed space, in constant contact with one of said fixed contacts and being capable of resiliently deforming between a normal state when no force is applied thereon and a first strained state corresponding to a first-stage pushing-down manipulation of said actuation member where at least part of said moving contact is brought into contact with at least one of the others of said fixed contacts, and (b) a central structure of generally partial hemispherical configuration (hemisphere structure), convexed in the same direction as the inflection of said frame structure, integrally formed with said frame structure but separated therefrom by at least one elongated and curved slot partially surrounding said central structure so that the latter is deformable at least partly independent of the deformation of said frame structure, capable of undergoing a resilient deformation between a first strained state where said central structure retains its partial hemispherical configuration while said frame structure undergoes its own deformation by said first stage pushing-down manipulation, and at least one further or second strained state corresponding to a second or further-stage push-down manipulation of said actuation member where said central structure is pushed-down whereby said central structure deforms to an upside-down inversed partial hemispherical configuration and is brought into contact with at least one more of the others of said fixed contacts. Thus, when pressing down a button, the notch-like touch is obtainable.

In the following description, the present invention will be elucidated in more detail by referring to a preferred embodiment shown in FIG. 1 through FIG. 5 of the attached drawings.

In each of those figures, the same numerals or letters are used for designating the same or similar parts or components throughout the several views. A case 1 of the switch made of an insulator has a recessed space defined by an inner side wall 101 and a bottom wherein a plurality of fixed contacts 2, 3, 4 and 5 are embedded. Lead-out terminal tabs 6*a*, 6*b*, 6*c* and 6*d*, each corresponding to and connected to the fixed contacts 2, 3, 4 and 5, respectively, are also embedded in the bottom of the case.

Of these fixed contacts 2, 3, 4 and 5, a fixed contact 2 is located at the periphery of the bottom disposed at the highest vertical position or elevation and a central fixed contact 4 is disposed at the lowest vertical position. Intermediate fixed contacts 3 and 5 are disposed midway between the peripheral and central contacts 2 and 4 in terms of their vertical positions. The contacts 3, 4 and 5 are arranged in a row.

A moving contact 10 is made of a resilient metal diaphragm plate and comprises a generally rectangular frame structure 10*a* of generally upwardly convexed segmental cylindrical configuration, and a central structure 10*b* of generally partial hemispherical configuration, convexed in the same direction as the inflection of said frame structure 10*a*. The central structure 10*b* is connected to the frame structure 10*a*, which has a periphery conforming to the inner side wall 10*l* of the recessed space, through two junction members 10*d* supported by side members 10*c* of said rectangular frame. The other side members 10*e* of the frame structure are inflected or curved upwardly about an axis generally parallel to the side members 10*c*. Numeral 10*f* indicates a center opening for engaging with an actuation member 11. The central structure overlies contacts 3, 4 and 5.

When the moving contact 10 is placed in the recessed space of the insulator case 1, a part of said frame structure 10*a* is brought into constant contact with the peripheral fixed contact 2 and thus the contact 10 is electrically connected to the fixed contact 2. The actuation member 11 is made of an insulator is generally rectangular to fit within the case 1, and has an integral projecting push-button 14 and an integrally formed projection 12 which engages with the central opening 10*f* of the central structure 10*b* of the moving contact 10 when the member 11 is placed in the recessed space of the case.

A lid 13, having a central opening 15 which accommodates the push button 14 of the actuation member 11 and four corner openings 17 which accommodate upward projections 16 integrally formed on the top face of the case 1, serves to movably retain the actuation member 11 in the case. The lid 13 is designed to be fixed on the case 1 by calking the heads of the projections 16 which pierce the openings 17.

Figure 2:
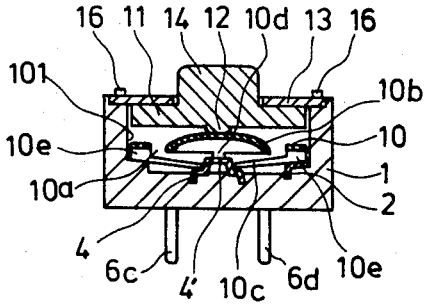
FIG. 2(*a*) is a sectional elevation view of the switch shown in FIG. 1, FIG. 2(*b*) is a plan view of the switch shown in FIG. 1 when some parts are removed therefrom.
Figure 2:
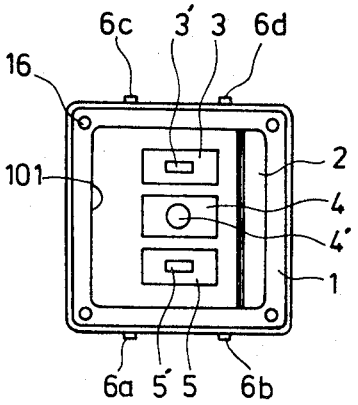
Figure 3:
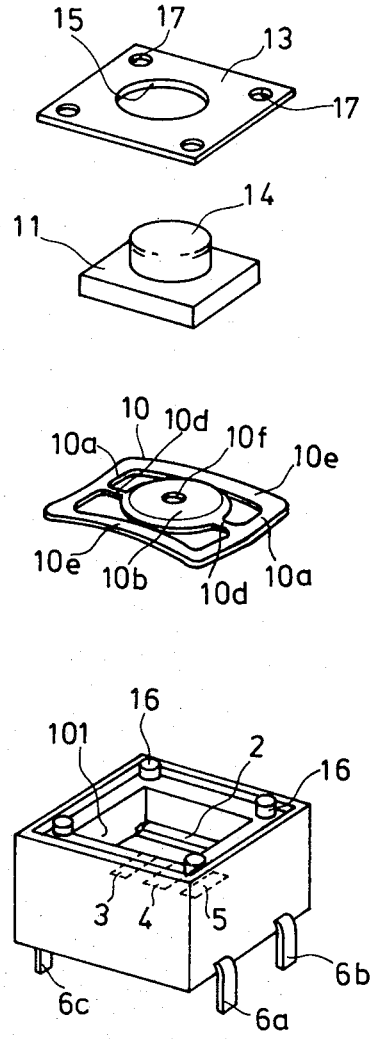
FIG. 3 is an exploded perspective view of the switch shown in FIG. 1, FIG. 4(*a*) is a plan view of a moving diaphragm contact of the switch shown in FIG. 1, FIG. 4(*b*) is an elevational view of the moving diaphragm contact shown in FIG. 4(*a*), FIGS. 5(*a*), 5(*b*) and 5(*c*) are sectional side views of the moving diaphragm contact cut along the line V—V of FIG. 4(*a*), for elucidating the mode of its deformation, FIG. 6(*a*) is a plan view of a moving diaphragm contact of another embodiment of the present invention, FIG. 6(*b*) is an elevational view of the moving contact shown in FIG. 6(*a*), and FIG. 6(*c*) is a plan view of a switch wherein the moving contact shown in FIGS. 6(*a*) and 6(*b*) is installed.
Figure 4:
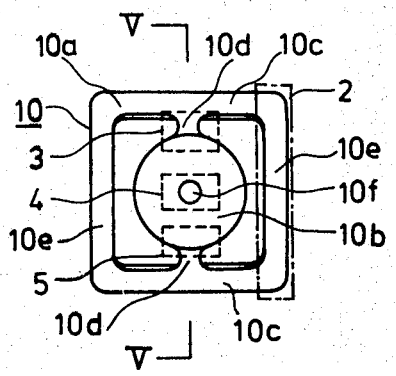
Figure 4:
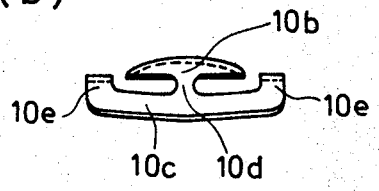
Figure 5:
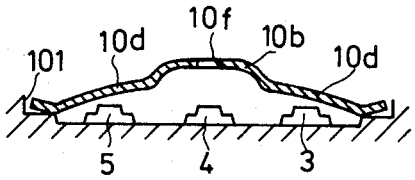
Figure 5:
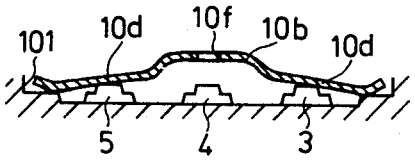
Figure 5:
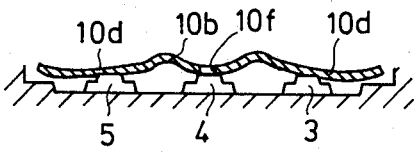

An arrangement of the assembled components is shown in FIGS. 1, 2(*a*) and 2(*b*), wherein only part of the frame structure 10*a* of the moving contact 10 engages with the peripheral fixed contact 2 (FIG. 5(*a*)) and only the central structure 10*b* engages with the projection 12 of the actuation member 11. In this arrangement, when the actuation member 11 is first pushed down, only the frame structure 10*a* deforms to make the peripheral edge portion of the central structure 10*b* engage with the intermediate fixed contacts 3 and 5 to make the fixed contacts 2, 3 and 5 conductive through the moving contact 10 (FIG. 5(*b*)). This state corresponds to a first stage of pushing-down manipulation of the actuation member 11.

When the actuation member 11 is pushed down further from this state, the central structure 10*b* of the moving contact 10, in turn, deforms to cause its center to engage with the central fixed contact 4. As a result, all of the fixed contacts 2, 3, 4 and 5 are connected each other through said moving contact 10 (FIG. 5(*c*)). This state corresponds to a second stage of pushing-down manipulation of the actuation member 11.

When the pushing-down manipulation on the actuation member 11 is removed therefrom, the central structure 10*b* of the moving contact 10 first returns to its initial state to separate from the fixed contact 4, and then the frame structure 10*a* follows to separate from the fixed contacts 3 and 5. The actuation member 11 returns to its initial position by the resilience of the moving contact 10. By arranging the switch as indicated above, a two-stage switching function can be made possible by a single pushing-down manipulation of the actuation member 11.

Figure 6:
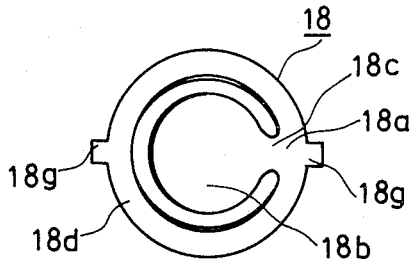
Figure 6:
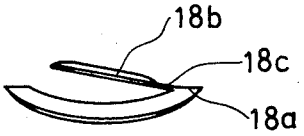
Figure 6:
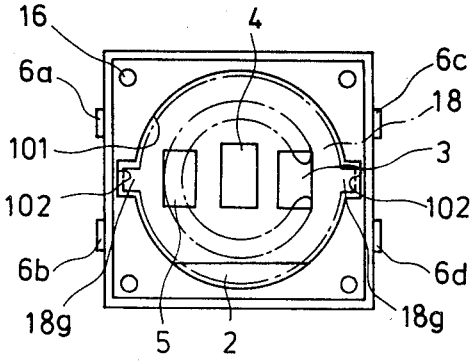

In the abovementioned embodiment, the frame structure 10*a* has a rectangular shape, but it may alternatively be made to have a circular shape 18*a* as indicated in another embodiment shown in FIGS. 6(*a*), 6(*b*) and 6(*c*). In this embodiment, the central structure 18*b* of the moving contact 18 is designed to be supported by the frame structure 18*a* through a single junction member 18*c*, instead of two as in the previously described embodiment. Furthermore, the frame structure 18*a* is inflected upwardly about an axis generally parallel to a line passing through this connecting member 18*c* and diametrically aligned peripheral tabs 18*g* on the frame structure 18*a*. The moving contact 18, specifically shown in FIGS. 6(*a*) and 6(*b*), of a circular contour fitted to the inner side wall 101 is retained against rotation in the case by engagement of the tabs 18*g* in key grooves 102 provided along the inner side wall 101 of the recessed space.

As indicated above, by employing the moving contact, comprising the upwardly convexed frame structure and a central hemispherical structure integrally formed therewith in the space surrounded by said frame structure, built in accordance with the present invention, a two-stage switching function in a pushing-down manipulation of the actuation in the same direction can be provided to support the great practical advantage of the present invention over the prior art.

The entire arrangement of the switch of the present invention is simple, and it may be designed smaller and lighter than those of any conventional switch, because a single moving contact also serves as a resilient member for returning the actuation member to its initial position.

The switch of the present invention can advantageously be utilized in variety of electric appliances. Uses in tape recording machines for both audio and video signals may be exemplified as a two-speed feeding of tape such as in fast-forwarding or rewinding modes or in frame-showing and picture-searching modes.

What is claimed is:

1. A switch including an insulator case having a recessed space for accommodating therein, at least three fixed contacts fixedly disposed on the bottom thereof, a moving diaphragm-like contact of resilient metal capable of a vertical self-restoring deformation within said space, an actuator member capable of receiving a pushing-down manipulation and transmitting the corresponding downward movement to said moving contact to induce a sequential and resilient deformation of the moving contact, and a lid adapted to said recessed space and capable of holding said moving contact and said actuation member while permitting the deformation of the former and the vertical movement of the latter within said recessed space, characterized in that;

said moving contact comprises (a) a frame structure of upwardly-inflected generally segmental cylindrical configuration having a peripheral contour fitted to the inner side wall of said recessed space, and being in constant contact with one of said fixed contacts and capable of resiliently deforming between a normal state when no force is applied thereon and a first strained state corresponding to a first-stage pushing-down manipulation of said actuation member where at least part of said moving contact is brought into contact with at least one of the others of said fixed contacts, and (b) a central structure of generally partially hemispherical configuration, convexed in the same direction as the inflection of said frame structure, integrally formed with said frame structure but separated therefrom by at least one elongated and curved slot partially surrounding said central structure so that the latter is deformable at least partly independent of the deformation of said frame structure, capable of undergoing a resilient deformation between a first strained state where said central structure retains said partial hemispherical configuration while said frame structure undergoes its own deformation by said first-stage pushing-down manipulation, and at least one further strained state corresponding to a further stage pushing-down manipulation where said central structure deforms to an inversed partially hemispherical configuration and is brought into contact with at least one more of the others of said fixed contacts.

2. A switch as claimed in claim 1, wherein said hemispherical structure is connected to said frame structure of said moving contact by two aligned junction members, and said frame structure is upwardly inflected about an axis generally transverse of said two junction members.

3. A switch as claimed in claim 1, wherein said hemispherical structure is connected to said frame structure of said moving contact by one junction member, and said frame structure is upwardly inflected about an axis generally parallel to said junction member.

4. A switch as claimed in claim 1, wherein said fixed contacts comprise:

at least one peripheral fixed contact disposed at a peripheral position and at the highest vertical position with respect to the other fixed contacts, and being in constant contact with said frame structure of said moving contact, a central fixed contact disposed at the central position and the lowest vertical position, and at least one intermediate fixed contact disposed midway between said peripheral and central fixed contacts and at an intermediate vertical position with respect to those of the other fixed contacts, wherein said intermediate fixed contact is brought into contact with said moving contact in response to said first-stage pushing-down manipulation of said actuation member, and said central fixed contact is brought into contact with said hemispherical structure in response to said second-stage pushing-down manipulation of said actuation member.

5. A switch as claimed in claim 1, wherein said actuation member is made of an insulator and has a projection which engages within a hole in said hemispherical structure of said moving contact.

6. In a switch including an insulator case having a recessed space for accommodating therein, at least three fixed contacts fixedly disposed on the bottom thereof, a moving contact of diaphragm-like resilient metal capable of a vertical self-restoring deformation within said recessed space, and an actuation member capable of receiving a pushing-down manipulation and transmitting the corresponding downward movement to said moving contact to induce a sequential and resilient deformation of the moving contact, and a lid for holding said moving contact and said actuation member while permitting the deformation of the former and the vertical movement of the latter within said recessed space, the improvement comprising:

(a) said fixed contacts comprise, a central fixed contact disposed at the central position and the lowest vertical position with respect to the other fixed contacts, at least one peripheral fixed contact disposed at a peripheral position and the highest vertical position, and at least one intermediate fixed contact disposed midway between said central fixed contact and said peripheral fixed contact and at an intermediate vertical position with respect to those of said central and peripheral contacts, (b) said moving contact comprises, a frame structure of upwardly inflected generally partially cylindrical configuration and having a contour fitted to the inner side wall of said recessed space and being in contact with said peripheral fixed contact, and capable of resiliently deforming between a normal state when no force is applied thereon and a first strained state corresponding to a first stage pushing-down manipulation of said actuation member, whereby said frame structure deforms to bring at least part of said moving contact into engagement with said intermediate fixed contact, and a central structure of generally partially hemispherical configuration, convexed in the same direction as the inflection of said frame structure, integrally formed with said frame structure but separated therefrom by at least one elongated and curved slot partially surrounding said central structure so that the latter is deformable at least partly independent of the deformation of said frame structure, capable of undergoing a resilient deformation between a first strained state where said central structure retains said partially hemispherical configuration while said frame structure undergoes its own deformation by said first stage pushing-down manipulation, and a second strained state corresponding to a second stage pushing-down manipulation of said actuation member, where said central structure deforms to an inversed partially hemispherical configuration and is brought into contact with said central fixed contact.

7. A switch as claimed in claim 6, wherein said hemispherical structure is connected to said frame structure of said moving contact by two aligned connecting parts, and said frame structure is upwardly inflected about an axis generally transverse of said connecting parts.

8. A switch as claimed in claim 6, wherein said hemispherical structure is connected to said frame structure of said moving contact by one connecting part, and said frame structure is upwardly inflected about an axis generally parallel to said connecting part.

9. A switch including an insulator case having a recessed space for accommodating therein, at least three fixed contacts fixedly disposed on the bottom thereof, a moving contact of diaphragm-like resilient metal capable of a vertical self-restoring deformation within said space, an actuation member capable of receiving a pushing-down manipulation and transmitting the corresponding downward movement to said moving contact to induce a sequential and resilient deformation of the moving contact, and a lid adapted to said recessed space and capable of holding said moving contact and said actuation member while permitting the deformation of the former and the vertical movement of the latter within said recessed space, said moving contact comprising a frame structure and a central structure, said frame structure being in constant contact with one of said fixed contacts and capable of resiliently deforming between a normal state when no force is applied thereon and a first strained state corresponding to a first-stage pushing-down manipulation of said actuation member where at least part of said moving contact is brought into contact with at least one of the others of said fixed contacts, and said central structure being of generally partial hemispherical configuration and capable of deformation at least partly independent of the deformation of said frame structure, and capable of undergoing a resilient deformation between first strained state where it retains said generally hemispherical configuration while said frame structure undergoes its own deformation by said first-stage pushing-down manipulation, and at least one further strained state corresponding to a further-stage pushing-down manipulation of said actuation member, where said central structure deforms to an upside-down inversed hemispherical configuration and is brought into contact with at least one more of the others of said fixed contacts, characterized in that (a) said frame structure is of upwardly-inflected generally partially cylindrical configuration and has a contour fitted to the inner side wall of said recessed space, and (b) said central structure is integrally formed with said frame structure but separated therefrom by at least one elongated and curved slot partially surrounding said central structure.

10. A switch including an insulator case having a recessed space for accommodating therein, at least three fixed contacts fixedly disposed on the bottom thereof, a moving contact of diaphragm-like resilient metal capable of a vertical self-restoring deformation within said space, an actuation member capable of receiving a pushing-down manipulation and transmitting the corresponding downward movement to said moving contact to induce a sequential and resilient deformation of the moving contact, and a lid adapted to said recessed space and capable of holding said moving contact and said actuation member while permitting the deformation of the former and the vertical movement of the latter within said recessed space, said moving contact comprising a frame structure and a central structure, characterized in that said frame structure is of upwardly-inflected generally partially cylindrical configuration and having a circular contour fitted to the inner side wall of said recessed space, further having key-projections fitting key grooves provided along said inner side wall of said recessed space, and being in constant contact with one of said fixed contacts and capable of resiliently deforming between a normal state when no force is applied thereon and a first strained state corresponding to a first-stage pushing-down manipulation of said actuation member where at least part of said moving contact is brought into contact with at least one of the others of said fixed contacts, said central structure is of generally partial hemispherical configuration to produce a snapping action convexed in the same direction as the inflection of said frame structure, integrally formed with said frame structure but separated therefrom by at least one elongated and curved slot partially surrounding said central structure so as to be deformable at least partly independent of the deformation of said frame structure, capable of undergoing a resilient deformation between a first strained state where it retains said generally hemispherical configuration while said frame structure undergoes its own deformation by said first-stage pushing-down manipulation, and at least one further strained state corresponding to a further-stage pushing-down manipulation of said actuation member, where said central structure deforms to an upside-down inversed hemispherical configuration and is brought into contact with at least one more of the others of said fixed contacts, said hemispherical structure is connected to said frame structure of said moving contact by a junction member, and said frame structure is upwardly inflected about an axis generally parallel to said junction member, and said fixed contacts comprise;

at least one peripheral fixed contact disposed at a peripheral position and the highest vertical position with respect to the other fixed contacts, and being in constant contact with said frame structure of said moving contact, a central fixed contact disposed at the central position and the lowest vertical position, and at least one intermediate fixed contact disposed at a position midway between said peripheral and central fixed contacts and at an intermediate vertical position with respect to those of the other fixed contacts, wherein, said intermediate fixed contact is brought into contact with said moving contact in response to said first-stage pushing-down manipulation of said actuation member, and said central fixed contact is brought into contact with said hemispherical structure in response to said second-stage pushing-down manipulation of said actuation member.

11. A switch including an insulator case having a recessed space for accommodating therein, at least three fixed contacts fixedly disposed on the bottom thereof, a moving contact of diaphragm-like resilient metal capable of a vertical self-restoring deformation within said space, an actuation member capable of receiving a pushing-down manipulation and transmitting the corresponding downward movement to said moving contact to induce a sequential and resilient deformation of the moving contact, and a lid adapted to said recessed space and capable of holding said moving contact and said actuation member while permitting the deformation of the former and the vertical movement of the latter within said recessed space, said moving contact comprising a frame structure and a central structure, characterized in that said frame structure is of upwardly-inflected generally partially cylindrical configuration capable of producing a snapping action and having a contour fitted to the inner side wall of said recessed space, and being in constant contact with one of said fixed contacts and capable of resiliently deforming between a normal state when no force is applied thereon and a first strained state corresponding to a first-stage pushing-down manipulation of said actuation member where at least a peripheral part of said central structure is brought into contact with at least one of the others of said fixed contacts, said central structure is of generally partial hemispherical configuration capable of producing a snapping action, convexed in the same direction as the inflection of said frame structure, integrally formed with said frame structure but separated therefrom by at least one elongated and curved slot partially surrounding said central structure so that the latter is deformable at least partly independent of the deformation of said frame structure, capable of undergoing a resilient deformation between said first strained state where it retains said hemispherical configuration while said frame structure undergoes its own deformation by said first-stage pushing-down manipulation and at least one further strained state corresponding to a further-stage pushing-down manipulation of said actuation member where said central structure is pushed-down and deforms to an upside-down inversed hemispherical configuration and is brought into contact with at least one more of the others of said fixed contacts, and said central structure is connected to said frame structure of said moving contact by two junction members, and said frame structure is upwardly inflected about an axis transverse of said junction members.

* * * * *